US006023915A

United States Patent [19]

Colombo

[11] Patent Number: 6,023,915

[45] Date of Patent: Feb. 15, 2000

[54] MODIFIED ATMOSPHERE PACKAGING METHOD

[76] Inventor: Edward A. Colombo, 2234 Baird Rd., Penfield, N.Y. 14526

[21] Appl. No.: 09/182,754

[22] Filed: Oct. 29, 1998

[51] Int. Cl.[7] ..... B65D 81/20

[52] U.S. Cl. ..... 53/432; 206/204; 206/213.1; 206/524.8; 426/106; 426/107

[58] Field of Search ..... 53/432; 206/204, 206/205, 213.1, 363, 438, 522, 524.8; 426/106, 107, 118

[56] References Cited

U.S. PATENT DOCUMENTS

| | | | |
|---|---|---|---|
| 3,521,806 | 7/1970 | Esty | 206/213.1 |
| 4,247,517 | 1/1981 | Sanderson et al. | 206/524.8 |
| 4,372,921 | 2/1983 | Sanderson et al. | 206/524.8 |
| 4,548,824 | 10/1985 | Mitchell et al. | 206/524.8 |
| 5,561,915 | 10/1996 | Vandergriff | 206/213.1 |
| 5,628,404 | 5/1997 | Hendrix | 206/524.8 |
| 5,705,210 | 1/1998 | Sillince et al. | 53/432 |

*Primary Examiner*—Jim Foster
*Attorney, Agent, or Firm*—Howard J. Greenwald

[57] ABSTRACT

A package for storing oxygen sensitive goods includes a first web in the form of a tray which may include flanges, a valve or valves, carbon dioxide, a good or goods, such as red meat or other oxygen sensitive food and non-food products and a second web sealed to the tray in the form of a gas impermeable film to which has been fitted a one-way valve. The pressure within the package increases as a gaseous modified atmosphere is introduced through the one-way valve in the tray. The oxygen within the barrier bag is forced out of the one-way valve located on the film. A vacuum applied to the one-way valve on the film facilitates the removal of oxygen. Additionally, the atmosphere within the bag can be monitored by locating sensors within the gas stream leaving the one-way valve in the film as it leaves the interior of the package.

11 Claims, 7 Drawing Sheets

MODIFIED ATMOSPHERE PACKAGING METHOD

FIELD OF THE INVENTION

The present invention relates generally to a package and novel method for producing a Modified Atmosphere Package useful for the preservation and shelf life extension of food and non-food oxygen sensitive items.

DESCRIPTION OF THE PRIOR ART

It is well established that the shelf life of products can be extended by packaging them in a modified gaseous environment. For example packaging these products in an oxygen poor gaseous environment (Meat Preservation, by Robert G. Cussens, Food & Nutrition Press, Inc. 1994) can extend the shelf life of fresh meat products.

Alternatively, non-food products such as metals, which react with oxygen in a degradative manner, can be stored in oxygen poor gaseous environments to prevent oxidation or "rusting" and thus enhance their useful life.

The relationship between shelf life and the gaseous environment surrounding a product is complex. For fresh cut meats, exposure to an ambient oxygen atmosphere causes the proteins contained in the meat to oxidize, thus turning the meat color from a bright red to a brown color. The relationship between meat color and oxygen concentration is well established (Principles of Meat Science, Third Edition, by Hedrick et al., Kendall/Hunt Publishing Company 1994). In addition, the growth of bacteria is enhanced by the presence of ambient oxygen. This combination of color change and bacteria growth renders the meat product unfit for sale after 3–5 days. The shelf life of the meat product can be extended by storing the fresh cut meat in an atmosphere of 100% carbon dioxide or combinations of carbon dioxide and nitrogen as well as high and low levels of oxygen in combination with nitrogen (Meat Preservation, by Robert G. Cussens, Food & Nutrition Press, Inc. 1994). The maximum shelf life extension of fresh meats is achieved with 100% carbon dioxide. U.S. Pat. No. 5,667,827 naming Dennis J. Breen and Lawrence Wilson as inventors provides a more detailed description of 100% carbon dioxide environments.

The ultimate shelf life extension of fresh meats is determined not only by the environment surrounding the fresh meat but also by the holding or storage temperature. In the case of fresh meat, the natural degradative metabolic process can be slowed by storing the meat in a 100% carbon dioxide atmosphere (or an oxygen level of <500 PPM) and maintaining the meat temperature at approximately 30.2 F. The importance of maintaining the proper meat temperature has been discussed in a recent publication (The National Provisioner, April 1998).

While the environment of 100% carbon dioxide extends the shelf life of fresh meat, the meat must be exposed to ambient conditions (21% oxygen) prior to retail sale. This exposure to ambient oxygen causes the meat to bloom or assume a cherry or bright red color. This color change must be present in order for the meat to be consumer acceptable.

This "blooming" can be accomplished by providing a means to expose the meat to an oxygen rich environment prior to retail sale. The prior art is replete with examples of methods to accomplish "blooming", such as removable domes (Garwood U.S. Pat. Nos. 4,685,274, 4,801,347, 5,025,611, 5,103,618, 5,129,512, 5,155,974, 5,226,531, and 5,323,590), peelable films (Gorlich U.S. Pat. Nos. 5,334,405, 5,348,752, 5,439,132, and 5,419,097), master bags (Breen/Wilson U.S. Pat. Nos. 5,711,978 and 5,667,827) and disposable barrier bags (Tenneco U.S. Pat. Nos. 5,698,250 and 5,811,142).

While establishing and maintaining the desired meat temperature is reasonably easy, establishing and maintaining the meat in a 100% carbon dioxide environment can be difficult and complex.

Heretofore systems have been described to achieve this desirable modified atmosphere condition. Previous systems have been described in the following patents to achieve this desired state: U.S. Pat. Nos. 4,685,274, 4,801,347, 5,025,611, 5,103,618, 5,129,512, 5,155,974, 5,226,531, and 5,323,590 all naming Anthony J. Garwood as the inventor; U.S. Pat. Nos. 5,711,978 and 5,667,827 naming Dennis J. Breen and Lawrence Wilson as the inventors; U.S. Pat. Nos. 5,698,250 and 5,811,142 naming Gary R DelDuca, Alan E. Deyo, Vinod K Luthra and Wen P Wu as the inventors; and U.S. Pat. Nos. 5,334,405, 5,348,752, 5,439,132, and 5,419,097 naming Michael P. Gorlich as the inventor. In all of the referenced patents, the techniques require and/or use, complicated and expensive techniques/machines/packages including evacuation, gas flushing, oxygen absorbers, peelable seals, and complex coextruded and laminated films.

The systems described in the prior art establish the modified atmosphere within the package before the internal package environment is separated from the ambient conditions.

For example, scenarios include evacuation, gas flushing and incorporation of oxygen absorbers before an individual layer or layers of permeable and impermeable films and/or bags or a combination thereof are sealed or adhered to the container used to hold the food product.

Additionally, the previously referenced equipment, materials, and systems used to produce a modified atmosphere are costly, complex, and difficult to maintain. In addition, the machinery and processing steps are not conducive to small packaging operations.

As an example, Multivac produces and supplies machines which evacuate and establish a modified atmosphere prior to sealing a film to the tray package as described in their sales literature.

Since there are a multitude of shelf life extension methods described, large and small food packers have been reluctant to convert to one of these methods due to the large capital investment required for machinery. The food packers are fearful another system will come along to replace the one they have chosen. Thus market conversion to extended shelf life products in the US has been slow to occur.

Additionally, the previously referenced methods establish the modified atmosphere contemporaneously with the exclusion of oxygen. In other words, the atmosphere cannot be readily changed after it is established because no means is provided to modify the atmosphere within the container without destroying the container.

Further, the pressure of the modified atmosphere established with the prior art is generally limited to one atmosphere although the benefits of higher pressures have been established. These benefits include rapid absorption of carbon dioxide by the meat which slows the growth of certain bacteria (Controlled/Modified Atmosphere/Vacuum Packaging of Foods, by Brody, Food & Nutrition Press, Inc. 1994), prevention of package collapse due to the absorption of carbon dioxide by fresh meat and a cushioning effect which protects the product during shipment.

Providing a simple reusable means for establishing a modified atmosphere subsequent to sealing a barrier film to a barrier tray has several significant advantages over methods which establish a modified atmosphere prior to sealing a barrier film to a barrier tray. Several of these advantages are discussed below. The integrity of each package can be checked to determine if there are any leaks. Machine cost is lower and machine complexity is reduced. Production rates (packages produced per minute) can be increased. Poor seals between the barrier film and the barrier tray can be repaired and the modified atmosphere re-established within the package thus reducing the cost associated with discarding a package. Smaller amounts of gas can be used since the volume of the finished package is much lower than the volume of evacuation chambers, thus lowering the cost and the time it takes to replace the atmosphere within the package. The environment within the package can be easily changed from low oxygen to high oxygen at point of sale to effect "meat blooming" which is required for consumer acceptance. Additives can easily be incorporated into the finished package. Examples include film anti-fogging agents, meat tenderizing agents and anti-microbial compounds as well as others which may extend or otherwise enhance the quality of the packaged product. The same package can be used to establish a low oxygen environment, a high oxygen environment or a vacuum environment. The overall amount of packaging used is reduced thus providing a favorable impact on the environment. A self-contained microwaveable package can be provided suitable for the reheating and/or cooking of food items.

SUMMARY OF THE INVENTION

The present invention provides a flexible low cost method for establishing a variety of modified atmosphere conditions within a package containing a food or non-food product or good after the environment surrounding the food or non-food good is separated from the ambient environment.

It has been discovered that a modified atmosphere can be achieved in a simple and heretofore unreported manner using readily available materials and techniques. Specifically, a gas impermeable container, tray or other structure is used to contain the oxygen sensitive food or non-food good. A quantity of solid carbon dioxide (or other controllable sources of carbon dioxide) may be placed in the tray. The tray is joined to a substantially oxygen impermeable film around the flanges of the tray by heat sealing, adhesives or other appropriate means. The impermeable film and/or the tray is fitted with one or more inexpensive one-way valves or a small hole which may be sealed at a later time, both methods providing a means for removing the oxygen rich atmosphere within the barrier bag/tray package.

The sublimation of the solid carbon dioxide serves to flush the oxygen from the package and vent it through the valves or hole previously fitted to the substantially oxygen impermeable film and/or the tray, thus creating an oxygen poor, carbon dioxide rich gaseous environment.

Alternatively, after sealing the substantially oxygen impermeable film to the tray, the oxygen rich atmosphere contained within the package may be removed and modified by supplying a vacuum device to a single valve and allowing a new gaseous atmosphere to enter through a second opposing valve or hole simultaneously or sequentially.

Alternatively, the oxygen concentration within the barrier film/tray package may be reduced by applying a vacuum source to the one-way valve or hole device after charging the tray with a weighed amount of solid carbon dioxide or other carbon dioxide source and sealing the gas impermeable film to the tray.

An example of how the present invention can be used to package fresh cut meats follows:

A fresh cut of meat is placed into a suitable container or tray, for example, a barrier polystyrene foam tray such as those available from Linpak, Amoco or Cryovac all located in the US.

The tray containing the meat is then heat sealed to a substantially oxygen impermeable film previously fitted with one or more controlled leak devices, such as a one-way valve (available from Plitek LLC of Des Plaines, Ill.) and sealed to create an isolated, contained gaseous environment. Prior to sealing the barrier film to the tray, a weighed amount of solid carbon dioxide or other carbon dioxide source is placed in the film/tray combination.

Alternatively, the barrier tray may be fitted with the one-way valve (available from Plitek LLC of Des Plaines Ill.) and then heat sealed to a substantially oxygen impermeable film.

Alternatively, the solid carbon dioxide can be eliminated and a contemporaneous or sequential combination of evacuation and back flushing with gaseous carbon dioxide or mixtures of carbon dioxide and nitrogen through the one-way valves or combination of valves and holes which may be sealed at a later time can be used to create a modified atmosphere within the barrier film/tray container or package.

Alternatively, an oxygen absorber (such as those manufactured by Multisorb of Buffalo, N.Y.) may be incorporated in the package thus eliminating the need for evacuation.

The structure so created is suitably weighed and labeled and held at a temperature of approximately 30.2 F. Shortly before retail sale (15–30 minutes) the one-way valve is removed or punctured thus exposing the fresh cut meat to an oxygen rich atmosphere. The oxygen rich atmosphere enters the package causing the meat to "bloom".

Other means may be used to expose the meat to an oxygen rich atmosphere. For example, holes may be placed in the barrier film or barrier tray and covered with a removable label or the barrier film/barrier tray package may be punctured at the retail establishment prior to retail sale.

Another embodiment of the invention provides even greater simplicity and still achieves and maintains an appropriate modified atmosphere within the package. In this embodiment a gas impermeable tray is again used to contain oxygen sensitive food or non-food goods. A gas impermeable lid or film is positioned over the goods and the tray. The lid incorporates a one-way valve on the top of the lid and the tray incorporates a one-way valve on the bottom of the tray. In this two valve configuration, a modified atmosphere can be introduced into the package through the valve on the bottom of the tray and the oxygenated atmosphere is allowed to escape through the one-way valve in the top of the lid. Furthermore, the gas escaping the one-way valve in the lid can be monitored to determine when the appropriate modified atmosphere levels have been reached within the package. With this two valve configuration, the need for solid carbon dioxide and/or an oxygen absorber is not required. In addition, meat blooming can be easily accomplished by introducing atmospheric air into the container through one or more valves.

One object of the present invention is to lower the cost of the package by using lower cost packaging and less complex machinery, thus making the process useful for small packaging operations and providing a cost incentive to large food packers to convert from present short shelf life packaging methods to extended shelf life techniques.

Another object of the present invention is to provide a package whereby the atmosphere within the package can be modified after the package is produced, thus reducing the need to throw away packages in which the atmosphere has been compromised.

Another object of the present invention is to provide individual packages of retail product in contrast to master bag methods which provides greater versatility for the customer.

Another object of the present invention is to provide a simple, versatile package in which the use of oxygen absorbers is optional, in which the use of a vacuum is optional and in which the resulting production cycle rate is higher than previous methods and systems. The optional use of oxygen absorbers and vacuums does not make the package more useful, they simply speed the saturation of carbon dioxide within the package.

Another object of the present invention is to provide a solution to the persistent problem of weighing and labeling the product. In the past this has proved difficult for most modified atmosphere packages, however, with the present invention the weighing and labeling can be accomplished very easily.

Another object of the present invention is to provide a means for removing oxygen that may have entered the package during storage by using a vacuum or other means without damaging the package.

Another object of the present invention is to provide a package that has many different applications. For instance, the present invention provides a package that can be used for hand packaging of prepared foods or other non-food items, such as oxygen sensitive parts/products.

Another object of the present invention is to provide a package, which can establish and maintain a carbon dioxide pressure of greater than one atmosphere to prevent package collapse due to the absorption of carbon dioxide by the fresh food products.

Another object of the present invention is to provide a package, which provides a cushion for the food product to prevent damage during shipment.

Another object of the present invention is to provide a package in which a 100% carbon dioxide environment can be used.

An additional benefit of the present invention is that the package pressure is self-adjusting. This feature can be important under conditions, which create lower external ambient pressures such as aircraft or ground shipment over high altitude areas.

Another benefit of the invention is the ability to check each package for leaks without destroying the package and also to determine the atmosphere within each package.

BRIEF DESCRIPTION OF THE DRAWINGS

In order that the invention can be more clearly ascertained examples of preferred embodiments will now be described with reference to the accompanying drawings.

DESCRIPTION OF PREFERRED EMBODIMENTS

Figure 1:
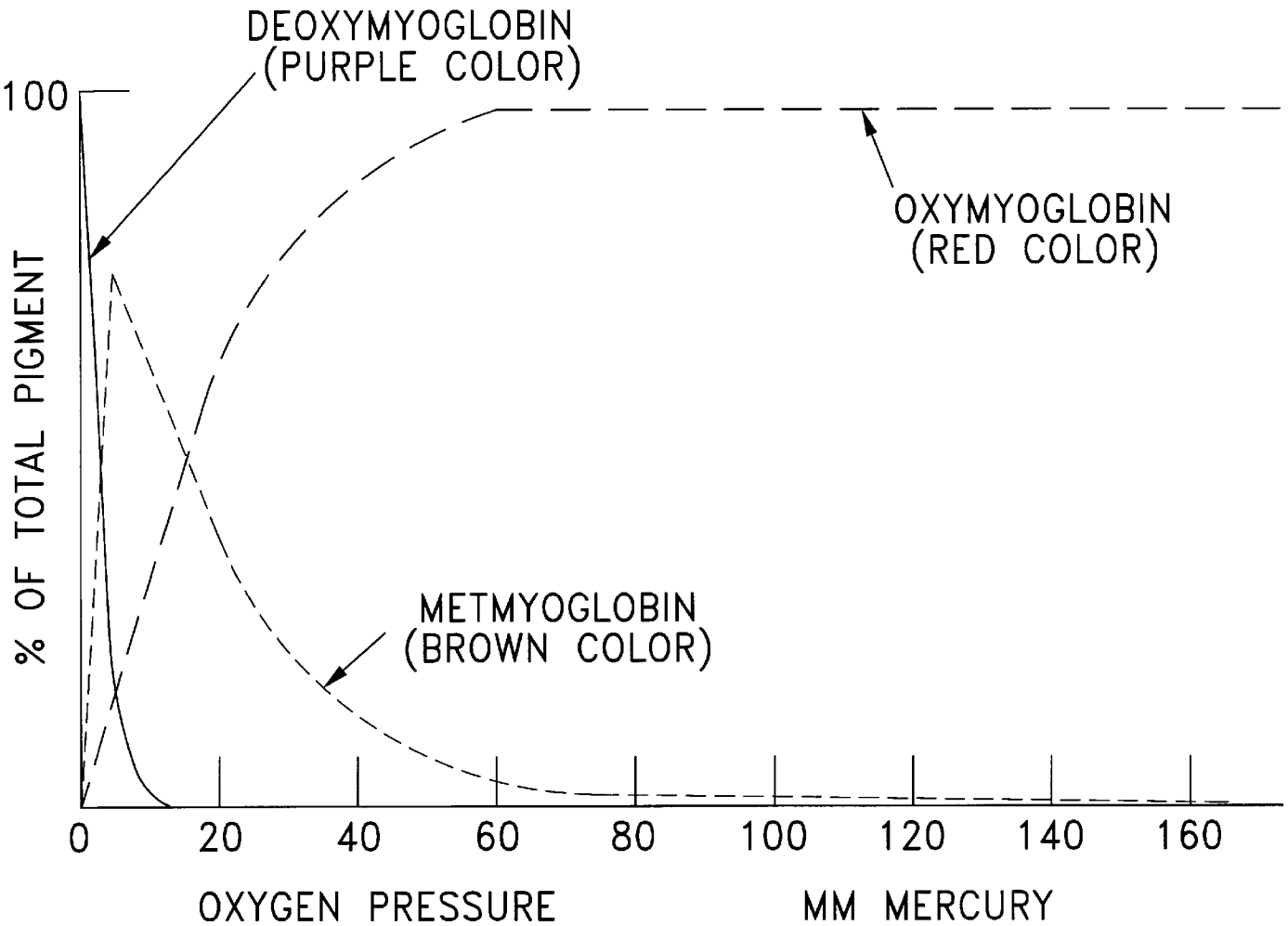
FIG. 1 shows the relationship between oxygen concentration and protein degradation on fresh meat (Principles of Meat Science, Third Edition, by Hedrick et al., Kendall/Hunt Publishing Company 1994.)

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

FIG. 1 illustrates the relationship of oxygen pressure to the pigment color and state in red meat products, as discussed more generally in this specification. This graphical illustration demonstrates the importance of "blooming" meat to make it more appetizing to the consumer.

Figure 2:
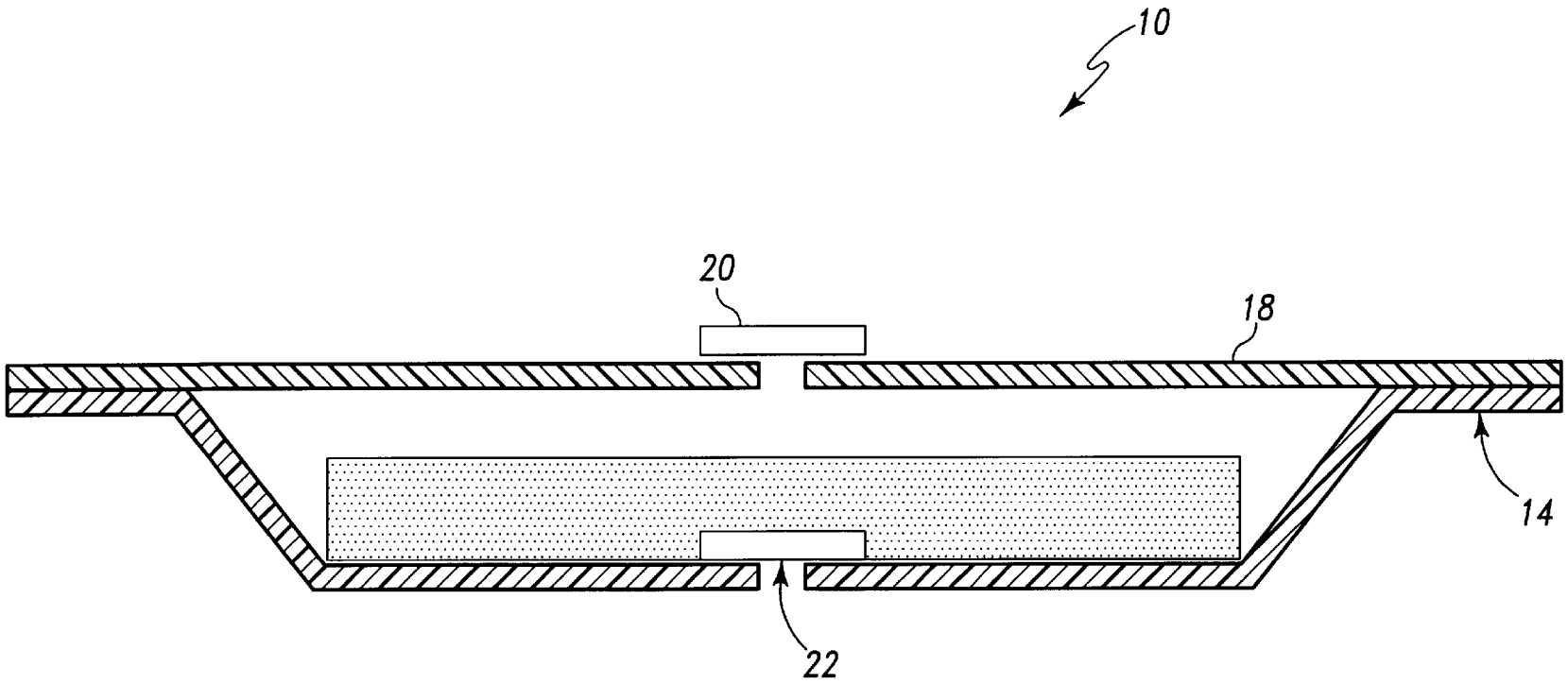
FIG. 2 is a side and cross-sectional view of a package containing a good according to one embodiment of the present invention.

Referring now to FIG. 2, a barrier film tray package 10 is shown including a gas impermeable tray 12 to contain oxygen sensitive food or non-food goods. A gas impermeable film or lid 18 is positioned over the goods and the tray 12. The tray 12 incorporates a first one-way valve 22 on the bottom of the tray 12 and the film 18 incorporates a second one-way valve 20 on the top of the film 18. In this two valve configuration, a modified atmosphere can be introduced into the package 10 through the first one-way valve 22 on the bottom of the tray 12 and the oxygenated atmosphere is allowed to escape through the second one-way valve 20 in the top of the film 18. The surfaces of the flanges 14 of the tray 12 and the edges of the film 18 are heat sealed to prevent gases from escaping the interior of the package 10. Furthermore, the gas escaping the second one-way valve 20 in the film 18 can be monitored to determine when the appropriate modified atmosphere levels have been reached within the package 10. With this two valve configuration, the need for solid carbon dioxide and/or an oxygen absorber is not required. Also, the two valve configuration allows for changing the gas within the package 10 or reparation of a damaged lid, tray, or heat seal if the damage is discovered before the meat has been exposed to oxygen for an extended period of time. The damaged lid, tray or seal can be repaired and a modified atmosphere reintroduced through the first one-way valve 22 in the bottom of the tray 12.

In the preferred embodiment, the package 10 can also be used in microwaveable applications since the pressure within the package 10 is self-venting. Unlike existing food packages on the market, the top of the package does not have to be peeled back or the contents removed from the package or holes punched in the film. Instead, the package 10 can be placed directly in the microwave oven. As the pressure builds inside the package due to the heat and energy generated from the microwave oven and the food products, the one-way valve 24 on the top of the tray 12 will vent, allowing gas to escape and equalizing the pressure within the package 10.

In the preferred embodiment, the tray 12 can be constructed of a thermoformable monolayer structure of APET (Amorphous Polyethylene Terephthalate) or PVC (poly vinylchloride) The total thickness of the material prior to thermoforming is approximately 0.010 to 0.030 inches. The tray 12 may be made of gas permeable or substantially gas impermeable materials. In the case of red meat or products, which may include liquids of any type; the tray material should be dense enough to prevent seepage of the liquid. Absorbent trays such as those supplied by Vitembal (France) or Linpak (US/Europe) or other means (absorbent pad) of absorbing liquids exuded from the meat may be employed. Also contemplated is a tray which can be constructed of material structures containing polyolefins such as PP (polypropylene)/PVDC (polyvinylidene chloride)/PP with tie layers between the PP and PVDC. Similarly, another polyolefin contemplated for use in tray material structures is HDPE (high-density polyethylene)/PVDC/HDPE with tie layers between the HDPE and the PVDC. Still other embodiments are contemplated in which the tray is constructed of a plastic foam, (open or closed cell) such as PS (polystyrene), PP (polypropylene), PVC, and APET and may include a substantially gas impermeable, plastic layer laminated thereto or any combination of plastic, paper, glass, aluminum or coatings, coextrusions or laminations of such materials such that the combination contemplated provides a barrier to oxygen permeation equal to or less than 0.5 cc-mil per 100 square inches area per day in ambient atmosphere at one atmosphere pressure.

In such an embodiment, the laminated barrier layer can be manufactured from a co-extruded LLDPE/PVDC/LLDPE structure with tie layers between the LLDPE and PVDC layers and with a thickness of approximately 0.003 to 0.006 inches or alternatively, it may be constructed of a polyamide such as nylon or alternatively, it may be constructed from a coextruded NYLON/EVOH structure laminated to a LLDPE or LLDPE/LDPE heat sealable layer with tie layers between the NYLON and EVOH layers said structure being commercially available from Allied Specialty Films in the United States.

Figure 3:
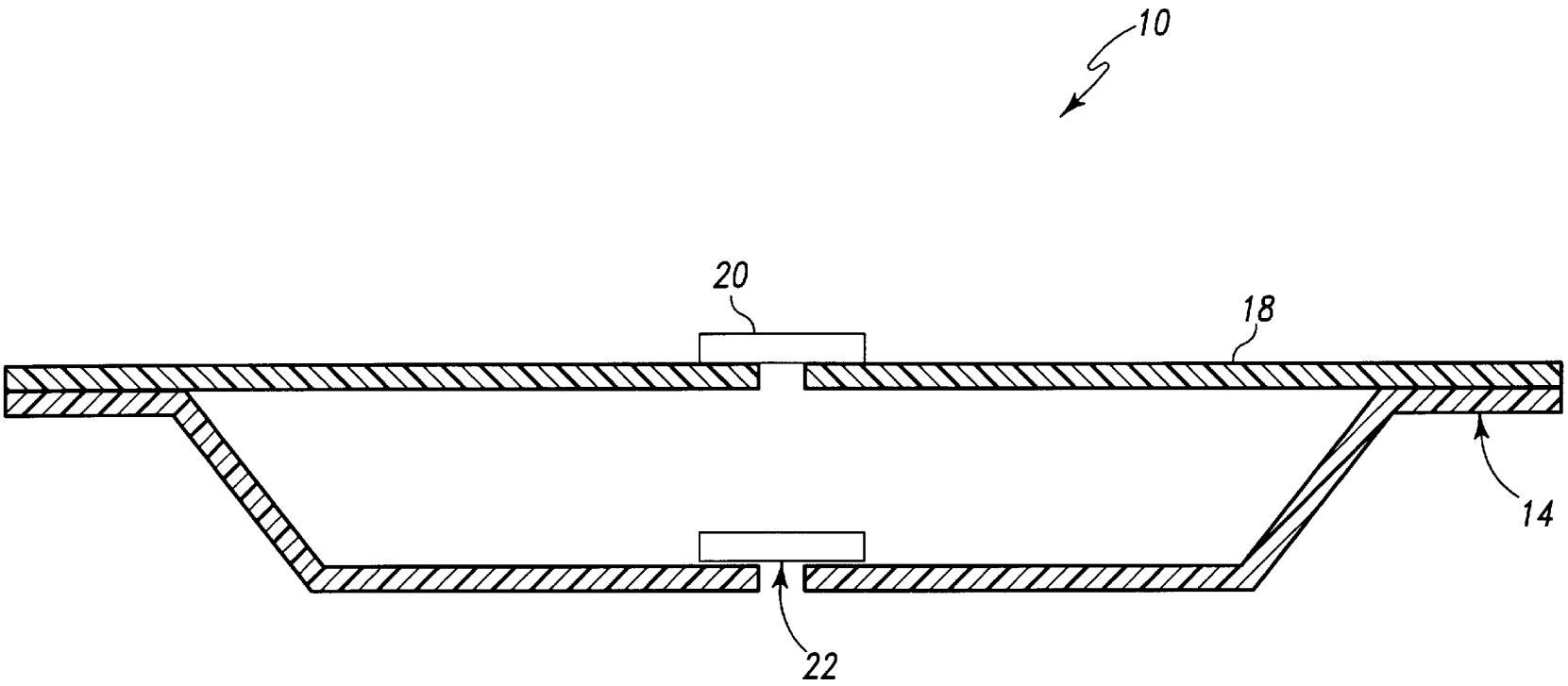
FIG. 3 is a side and cross-sectional view of a package which illustrates the process used with respect to the package described in FIG. 2 to attain a modified atmosphere within the package.

Referring now to FIG. 3, an illustration of the process used to replace the atmosphere within the package 10 described in FIG. 2 above with a modified atmosphere is shown. A modified atmosphere is introduced into the package 10 through the first one-way valve 22. The modified atmosphere is more dense than oxygen. This fact combined with the pressure in which the modified atmosphere enters the package 10 forces the oxygen up and out through the second one-way valve 20 in the film 18. If desired, the escaping gas through the second one-way valve 20 can be monitored to determine if the parts per million of oxygen has reached the necessary level within the package 10.

Figure 4:
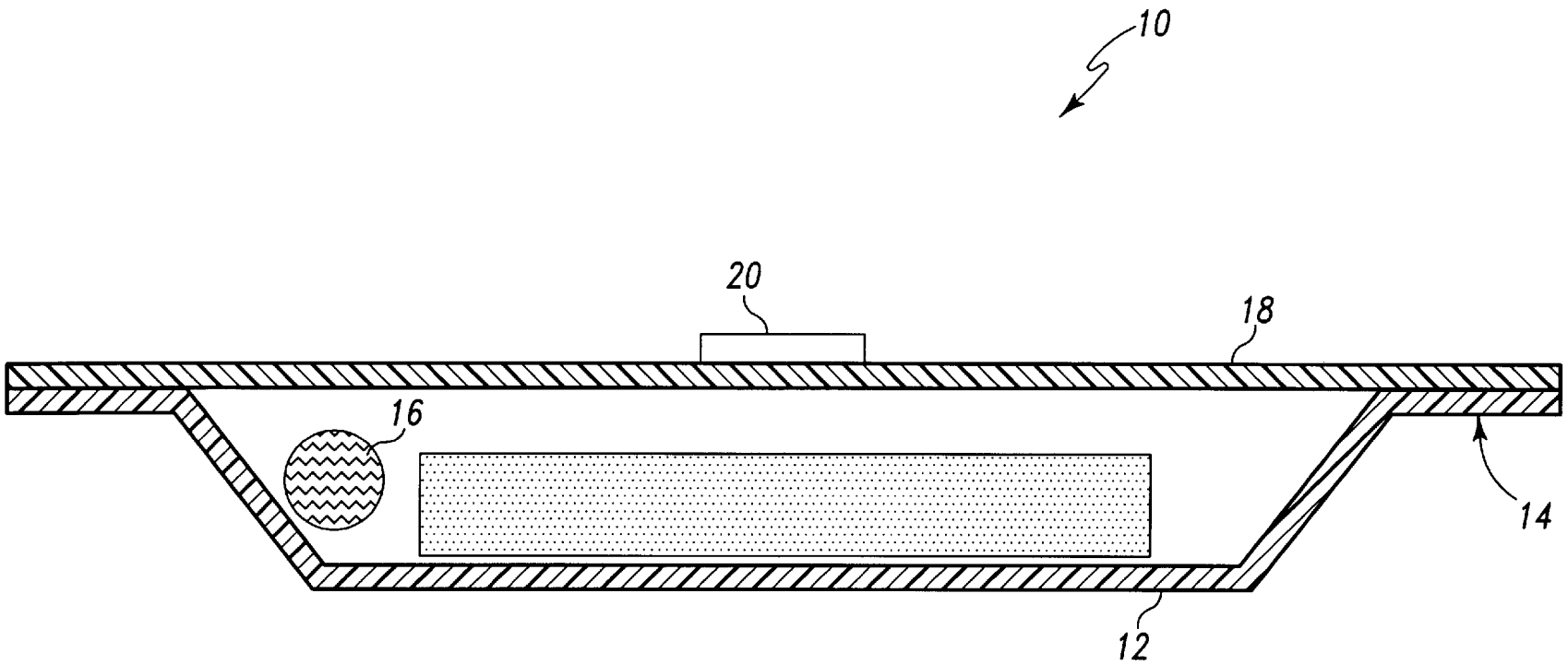
FIG. 4 is a side and cross-sectional view of a package containing a good according to second embodiment of the present invention.

Referring now to FIG. 4, a second embodiment of a barrier film tray package 10 is shown including a first web in the form of a gas impermeable tray 12 which includes flanges 14, solid carbon dioxide 16, a good or goods, such as red meat or other oxygen sensitive food and non-food products, disposed within the tray 12, and a second web 18 in the form of a gas impermeable film material, onto which has been fitted a one-way valve 20 such as the one-way valve produced by Plitek LLC of Des Plaines, Ill. The amount of solid carbon dioxide 16 used in the tray 12 varies depending on the type of good or goods disposed within the tray 12 and the size of the tray 12. In any event, there must be a sufficient quantity of solid carbon dioxide 16 to force the oxygen within the package 10 through the one-way valve 20 to leave a substantially 100% carbon dioxide atmosphere within the package 10.

As the solid carbon dioxide 16 sublimes, it accumulates in the barrier film/tray package 10, thus increasing the pressure within the package 10. Since the oxygen within the package 10 is less dense than the carbon dioxide, the oxygen gravitates toward the one-way valve 20 and the oxygen is forced out of the one-way valve 20 leaving substantially 100% carbon dioxide within the package 10. The one-way valve 20 is self-adjusting allowing the atmosphere within the package 10 to remain substantially 100% carbon dioxide since the pressure within the package 10 eventually equalizes with the ambient air pressure and no further atmosphere exchange takes place. While 100% carbon dioxide is desirable, an atmosphere within the package 10 of less than 500 PPM oxygen is satisfactory, especially for red meat. While food items have been discussed, this invention may also be applied to oxygen sensitive non-food items. It is likely in certain cases that a non-food item may require 100% carbon dioxide depending on the particular item, however, this invention provides such an atmosphere, especially if oxygen absorbers are used to remove oxygen. A vacuum can also be applied to the one-way valve to accomplish quicker evacuation of the oxygen from the package 10 both food and non-food items.

The one-way valves can be adjusted to allow pressure within the package to be greater than one atmosphere. With a pressure greater than one atmosphere, the food and non-food product can be naturally protected due to the formation of a "cushion" or barrier provided by the atmosphere within the package.

Figure 5:
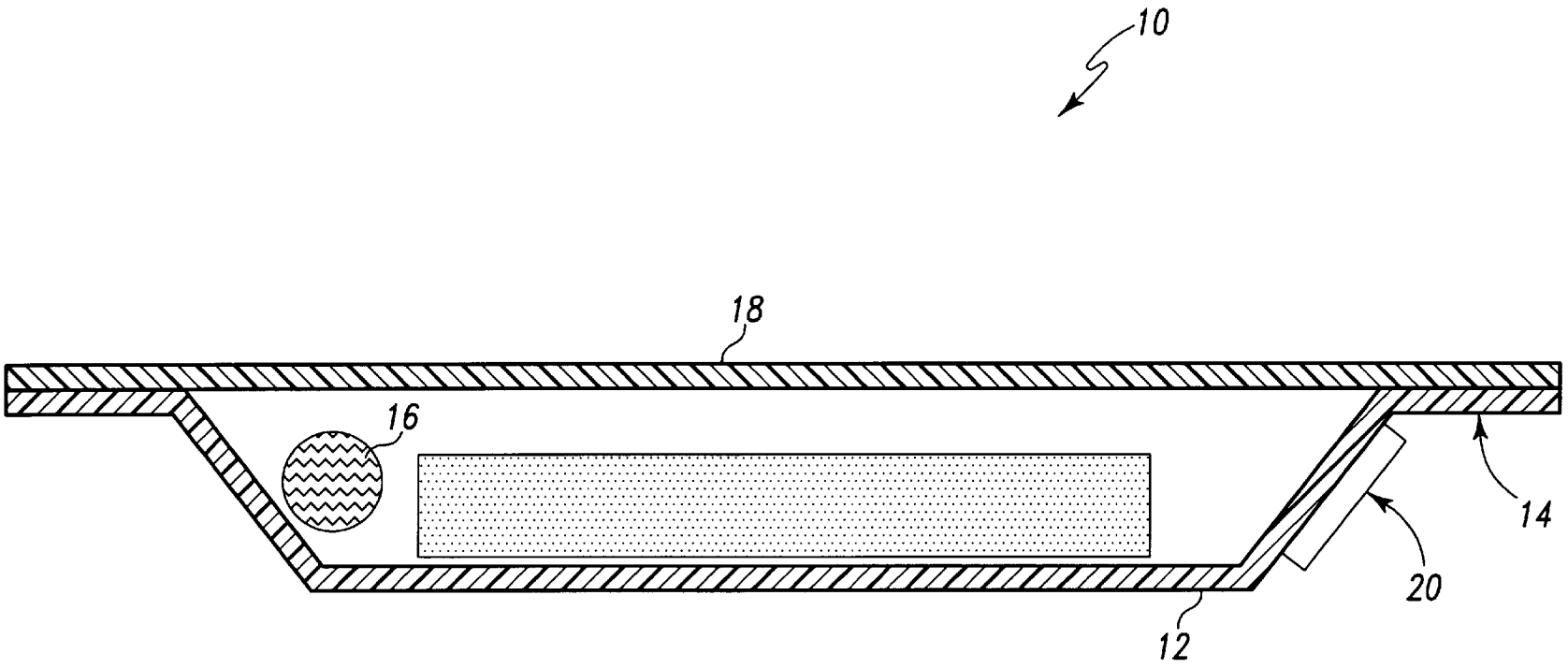
FIG. 5 is a side and cross-sectional view of a package containing a good according to a third embodiment of the present invention.

Referring now to FIG. 5, a third embodiment of the package 10 is shown. This embodiment is virtually identical to the package in FIG. 4 except the one-way valve 20 is placed on the tray 12 instead of the film 18. Functionally, the package 10 is identical, but personal preference or retail displays may necessitate the alternative placement of the one-way valve.

Figure 6:
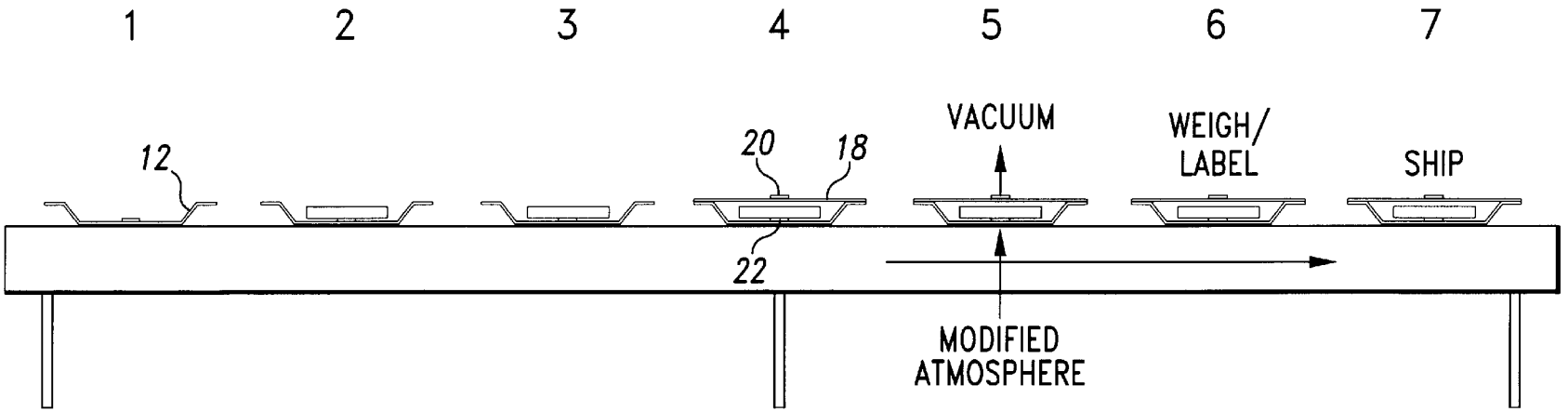
FIG. 6 is an illustration of the process used to manufacture the package described in FIGS. 2 and 3.

Referring now to FIG. 6, an illustration of the process used to manufacture the preferred embodiment of the package described in FIGS. 2 and 3 above is shown. Initially, an empty tray 12 with a one-way valve 22 proceeds down a conveyor line or other similar piece of equipment. A good or goods, such as meat, is then disposed within the tray 12. Next, a barrier film 18 fitted with a one-way valve 20 is sealed to the flanges 14 of the tray. Next, a modified atmosphere gas source is connected to the bottom of the tray 12 and a vacuum is applied to the one-way valve 20 to accomplish the evacuation of the oxygen from the package. Next, the package 10 is weighed and labeled and placed in a suitable packaging device, such as a cardboard carton. The ability to weigh and label the package at production is a significant improvement over previous designs.

Figure 7:
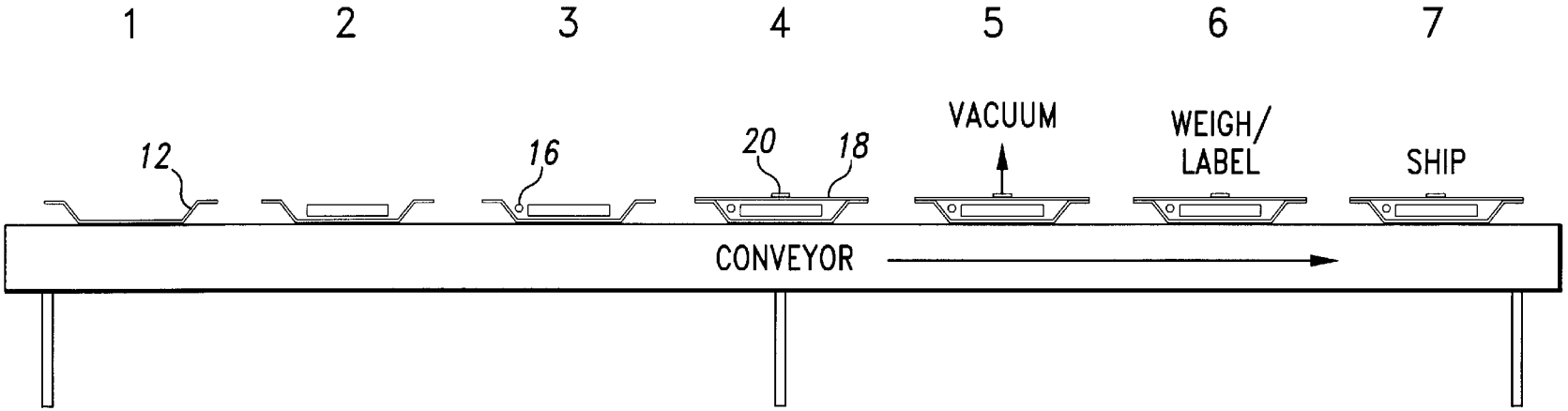
FIG. 7 is an illustration of the process used to manufacture the package described in FIGS. 4 and 5.

Referring now to FIG. 7, an illustration of the process used to manufacture the package described in FIGS. 4 and 5 above is shown. Initially, an empty tray 12 proceeds down a conveyor line or other similar piece of equipment. A good or goods, such as meat, is then disposed within the tray 12. A suitable quantity of solid carbon dioxide 16 is then placed in the tray 12. Next, a barrier film 18 fitted with a one-way valve 20 is sealed to the flanges 14 of the tray. The barrier film/tray package 10 can then be sent to a holding area to allow the carbon dioxide to sublime and force the oxygen from the barrier film/tray package 10 or a vacuum can be applied to the one-way valve 20 to accomplish the evacuation of the oxygen more rapidly. Next, the package 10 is weighed and labeled and placed in a suitable packaging device, such as a cardboard carton.

Upon arrival at its destination, the barrier film/tray package 10 is removed from the cardboard packaging and is exposed to the oxygen rich ambient atmosphere by adding an air source to the first one way valve 22 and pressing on the film 18 near the second one-way valve 20 to replace the modified atmosphere with oxygenated air at the retail store thus causing the meat to "bloom" or assume a red color. See FIG. 1 for a graphical illustration of how this "blooming" occurs. The atmosphere can also be replaced by other means to allow the passage of oxygen into the package 10, such as removing the second one-way valve 20. This invention is much lower in cost because none of the packaging, except the shipping carton, is discarded and expensive equipment is not required to produce the package.

The following examples illustrate the embodiment in FIG. 3.

EXAMPLE 1

A 30%/70% carbon dioxide/nitrogen gas mixture containing 0.004% oxygen at various flow rates was used to flush a one liter polystyrene foam barrier tray having dimensions of 5.5 inches×7.5 inches. The inside volume of the tray was measured by weighing the amount of water needed to fill the tray and was found to be one liter. The inside bottom of the tray was fitted with a 7.5 inch×1.75 inch Plitek valve. A barrier film obtained from Koch Inc., St. Louis, Miss. was heat sealed to the flange of the barrier tray. Finally, the barrier film was fitted on its outside surface with the same size valve as used in the tray bottom.

The oxygen content inside the tray as a function of time to reach 500 PPM was measured using a Model 9900 oxygen analyzer purchased from Topac Instrumentation, Hingham, Mass.

The results are shown below:

| GAS FLOW RATE Liters/minute | TIME TO REACH 500 PPM OXYGEN Seconds/$cm^3$ of container volume |
|---|---|
| 4.7 | 0.102 |
| 9.4 | 0.067 |
| 18.8 | 0.032 |
| 21.1 | 0.024 |
| 23.5 | 0.018 |
| 28.2 | 0.017 |

It can be seen that the time to reach 500 PPM oxygen approaches a constant value as the flow rate of gas increases. This is attributed to the limited size of the Plitek valve used in these experiments. Shorter times to reach 500 PPM can be obtained by using different valve sizes.

In addition the present data can be used to estimate the production rates to be expected for a given tray size (volume). For example, an empty one liter tray will have 300 $cm^3$ of free volume when meat is packaged in the tray. The time required to reduce the oxygen level to 500 PPM at a gas flow rate of 28.2 liter/minute is calculated as:

$$0.017 \text{ seconds/cm}^3 \times 300 \text{ cm}^3 = 5.1 \text{ seconds.}$$

This is equivalent to a production rate of 12 containers/minute. If higher production rates are required a larger valve can be installed.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

Other modifications may be made without departing from the ambit of the invention, the nature of which is to be determined from the foregoing description and appended claims.

What is claimed is:

1. A modified atmosphere package for storing oxygen sensitive goods, comprising:

a gas impermeable tray including flanges around the perimeter of said tray and fitted with a first one-way valve on the bottom of said tray to introduce a modified atmosphere within said package;

a gas impermeable film fitted with a second one-way valve, said film positioned over and adjacent to said flanges of said tray, said film is heat sealed to said flanges of said tray forming said package whereby said modified atmosphere flows from said first one-way valve through said package forcing the oxygen out of said second one-way valve to create a modified atmosphere within said package.

2. The package of claim 1, wherein a sensor is placed within the path of oxygen forced from said second valve to provide for the measurement of the atmosphere within said package.

3. A modified atmosphere package for microwaving food products, comprising:

a gas impermeable tray including flanges around the perimeter of said tray and fitted with a first one-way valve on the bottom of said tray to introduce a modified atmosphere within said package;

a gas impermeable film fitted with a second one-way valve, said film positioned over and adjacent to said flanges of said tray, said film is heat sealed to said flanges of said tray forming said package whereby said package is placed in a microwave oven and as heat and pressure build within said package, air escapes from said second one-way valve to provide for the integrity of said package and to facilitate the heating of the food product.

4. A modified atmosphere package for storing oxygen sensitive goods, comprising:

a gas impermeable tray including flanges around the perimeter of said tray;

solid carbon dioxide disposed within said tray;

a gas impermeable film fitted with a one-way valve, said film positioned over and adjacent to said flanges of said tray whereby said film is heat sealed to said flanges of said tray to provide for the sublimation of said carbon dioxide within said package which forces the removal of oxygen from within said package through said one-way valve.

5. The package of claim 3, wherein an oxygen absorber is disposed within said package to facilitate quicker removal of oxygen from said package.

6. The package of claim 3, wherein a vacuum is applied to said one-way valve to facilitate rapid removal of oxygen from said package.

7. A modified atmosphere package for storing oxygen sensitive goods, comprising:

a gas impermeable tray including flanges around the perimeter of said tray and fitted with a one-way valve to allow removal of oxygen within said package;

solid carbon dioxide disposed within said tray;

a gas impermeable film positioned over and adjacent to said flanges of said tray whereby said film is heat sealed to said flanges of said tray, whereby the sublimation of said carbon dioxide forces the removal of oxygen from within said package through said one-way valve.

8. The package of claim 6, wherein an oxygen absorber is disposed within said package to facilitate quicker removal of oxygen from said package.

9. The package of claim 6, wherein a vacuum is applied to said one-way valve to facilitate rapid removal of oxygen from said package.

10. A method for manufacturing a modified atmosphere package for storing oxygen sensitive goods, comprising:

placing an empty gas impermeable tray fitted with a first one-way valve on the bottom of said tray on a moving conveyor line;

disposing an oxygen sensitive good or goods within said tray;

disposing a gas impermeable film fitted with a second one-way valve above said tray and in contact with the flanges around the perimeter of said tray;

heat sealing said film to said flanges;

connecting a modified atmosphere gas source to said on-way valve on said tray and connecting a vacuum to said second one-way valve to provide for removal of oxygen from within said package;

weighing and labeling said package; and placing said package in a shipping carton.

11. A method for manufacturing a modified atmosphere package for storing oxygen sensitive goods, comprising:

placing an empty gas impermeable tray on a moving conveyor line;

disposing an oxygen sensitive good or goods within said tray;

placing solid carbon dioxide within said tray;

disposing a gas impermeable film fitted with a one-way valve above said tray and in contact with the flanges around the perimeter of said tray;

heat sealing said film to said flanges;

sending said package to a holding area to allow time for oxygen depletion within said package;

weighing and labeling said package; and placing said package in a shipping carton.

* * * * *